US008742995B2

(12) United States Patent
Park

(10) Patent No.: US 8,742,995 B2
(45) Date of Patent: Jun. 3, 2014

(54) EARPHONE ANTENNA OF MOBILE TERMINAL

(75) Inventor: Sung Ryong Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 163 days.

(21) Appl. No.: 13/401,194

(22) Filed: Feb. 21, 2012

(65) Prior Publication Data

US 2012/0218158 A1 Aug. 30, 2012

(30) Foreign Application Priority Data

Feb. 25, 2011 (KR) ..... 10-2011-0016952

(51) Int. Cl.
*H01Q 1/24* (2006.01)
*H01Q 3/24* (2006.01)
*H01Q 1/12* (2006.01)

(52) U.S. Cl.
USPC ..... 343/702; 343/718; 343/876

(58) Field of Classification Search
USPC ..... 343/718, 786, 702; 455/575.2, 575.6, 455/575.7, 569.1, 569.2; 381/74, 370, 384
See application file for complete search history.

(56) References Cited

U.S. PATENT DOCUMENTS 7,840,242 B2 * 11/2010 Yoshino ..... 455/575.2
8,428,670 B2 * 4/2013 Mukai et al. ..... 455/575.7
2009/0169044 A1 * 7/2009 Kashiwagi et al. ..... 381/384

FOREIGN PATENT DOCUMENTS

KR 10-0633690 B1 10/2006

* cited by examiner

*Primary Examiner* — Hoang V Nguyen
(74) *Attorney, Agent, or Firm* — Jefferson IP Law, LLP

(57) ABSTRACT

An earphone antenna of a mobile terminal having a switching function by taking radiation characteristics of an antenna into consideration when the earphone antenna is used for receiving Frequency Modulation (FM) radio broadcasting and Digital Multimedia Broadcasting (DMB) is provided. The earphone antenna includes a first connector cable including a first antenna line for receiving DMB, a second connector cable including a second antenna line connected to the first antenna line for receiving FM radio broadcasting, and a switch positioned between the first connector cable and the second connector cable for electrically connecting and separating the first antenna line to and from the second antenna line. The single earphone antenna supports an FM radio broadcasting antenna and a DMB antenna.

7 Claims, 7 Drawing Sheets

EARPHONE ANTENNA OF MOBILE TERMINAL

PRIORITY

This application claims the benefit under 35 U.S.C. §119 (a) of a Korean patent application filed on Feb. 25, 2011 in the Korean Intellectual Property Office and assigned Serial No. 10-2011-0016952, the entire disclosure of which is hereby incorporated by reference.

BACKGROUND OF THE INVENTION

1. Field of the Invention

The present invention relates to an earphone antenna of a mobile terminal. More particularly, the present invention relates to an earphone antenna of a mobile terminal having a switching function by taking radiation characteristics of an antenna into consideration when the earphone antenna is used to receive Frequency Modulation (FM) radio broadcasting and Digital Multimedia Broadcasting (DMB).

2. Description of the Related Art

Recently, mobile terminals equipped with a Digital Multimedia Broadcasting (DMB) function and a Frequency Modulation (FM) radio broadcasting function are being provided to address increased consumer demand. In order to receive DMB and FM radio broadcasting, an antenna is required, and specifically, an earphone antenna is widely used for FM radio broadcasting.

FIG. 1 illustrates an earphone antenna of a mobile terminal according to the related art.

Referring to FIG. 1, an earphone antenna 100 of a mobile terminal includes a connector cable 110, a left speaker cable 141L, and a right speaker cable 141R. The connector cable 110 has one end connected to a connector 120 and the other end connected to the left speaker cable 141L and the right speaker cable 141R. The left speaker cable 141L is provided with a left earphone speaker 140L formed at one end, and the right speaker cable 141R is provided with a right earphone speaker 140R formed at another end. An antenna line for FM radio broadcasting (not shown), which is electrically connected to the connector 120, is formed in the connector cable 110. The antenna line for FM radio broadcasting receives FM radio broadcasting when the connector 120 is connected to an ear jack 196 of a mobile terminal 190.

The earphone antenna 100 of the mobile terminal 190 receives only FM radio broadcasting and DMB is received by only a retractable antenna installed in the mobile terminal 190. However, the retractable antenna 195 takes up a large space in the mobile terminal 190, which increases the size of the mobile terminal 190.

Moreover, when the retractable antenna 195 is detachable, a connector for the connection of the retractable antenna 195 and the mobile terminal 190 is easily broken. Another disadvantage is that the connector and/or the detached retractable antenna 195 may be easily lost.

Therefore, a need exists for an earphone antenna of a mobile terminal for supporting antenna functions for FM radio broadcasting and DMB through a single antenna.

SUMMARY OF THE INVENTION

Aspects of the present invention are to address at least the above-mentioned problems and/or disadvantages and to provide at least the advantages described below. Accordingly, an aspect of the present invention is to provide an earphone antenna of a mobile terminal for supporting antenna functions for Frequency Modulation (FM) radio broadcasting and Digital Multimedia Broadcasting (DMB) through a single antenna.

In accordance with an aspect of the present invention, an earphone antenna of a mobile terminal is provided. The earphone antenna includes a first connector cable including a first antenna line for receiving DMB, a second connector cable including a second antenna line connected to the first antenna line for receiving FM radio broadcasting, and a switch positioned between the first connector cable and the second connector cable for electrically connecting and separating the first antenna line to and from the second antenna line.

The earphone antenna of a mobile terminal according to an exemplary embodiment of the present invention may include a switch for connecting and separating a first antenna line for receiving DMB to and from a second antenna line connected to the first antenna line for receiving FM radio broadcasting, so that a single antenna may support both antenna functions for FM radio broadcasting and DMB.

By doing so, the size of the mobile terminal may be reduced. Since the first antenna line is shared as a part of a DMB antenna and an FM radio broadcasting antenna, manufacturing costs may be reduced and user convenience may be achieved.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1:
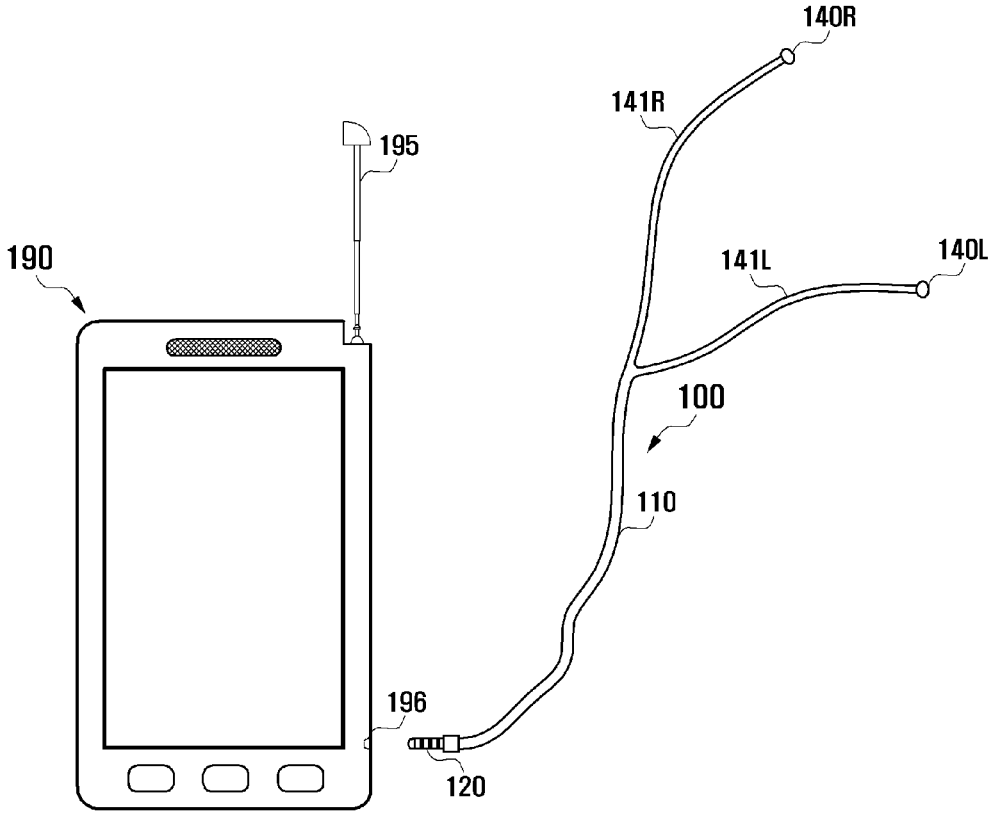
FIG. 1 (RELATED ART)
FIG. 1 illustrates an earphone antenna of a mobile terminal according to the related art.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Exemplary embodiments of the present invention proposed herein relate to an earphone antenna of a mobile terminal for supporting antenna functions for Frequency Modulation (FM) radio broadcasting and Digital Multimedia Broadcasting (DMB) through a single antenna.

FIGS. 2 through 7, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly stated otherwise. A set is defined as a non-empty set including at least one element.

Figure 2:
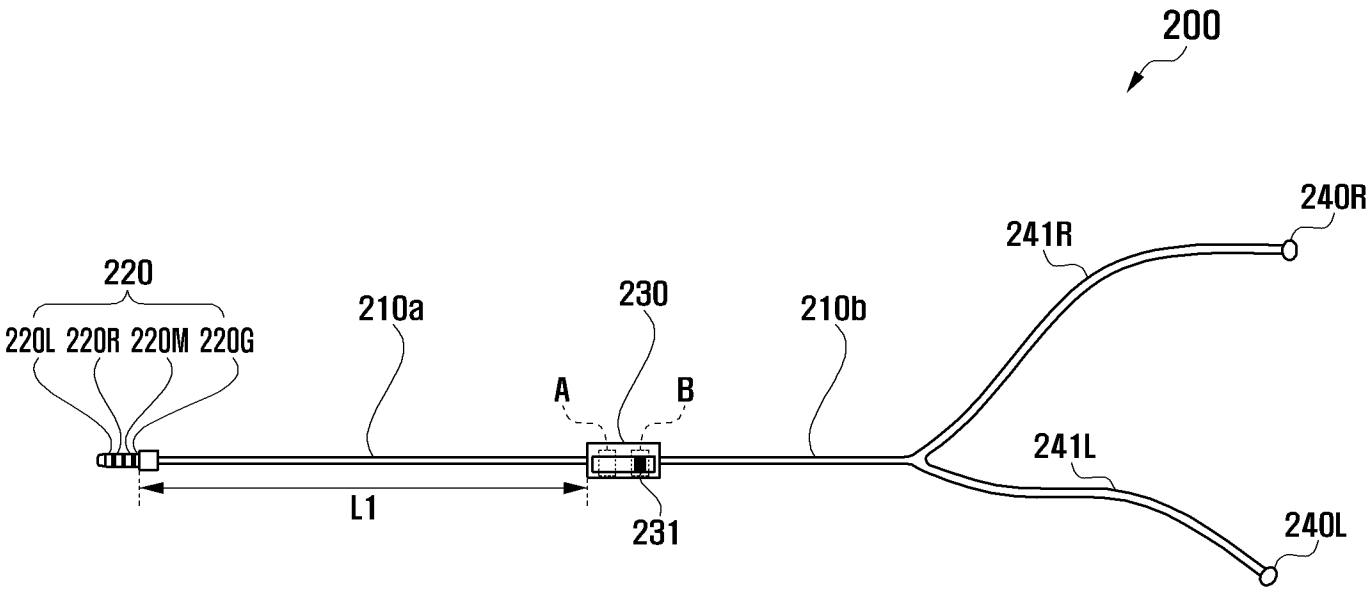
FIG. 2 illustrates an earphone antenna of a mobile terminal according to an exemplary embodiment of the present invention.
Figure 3:
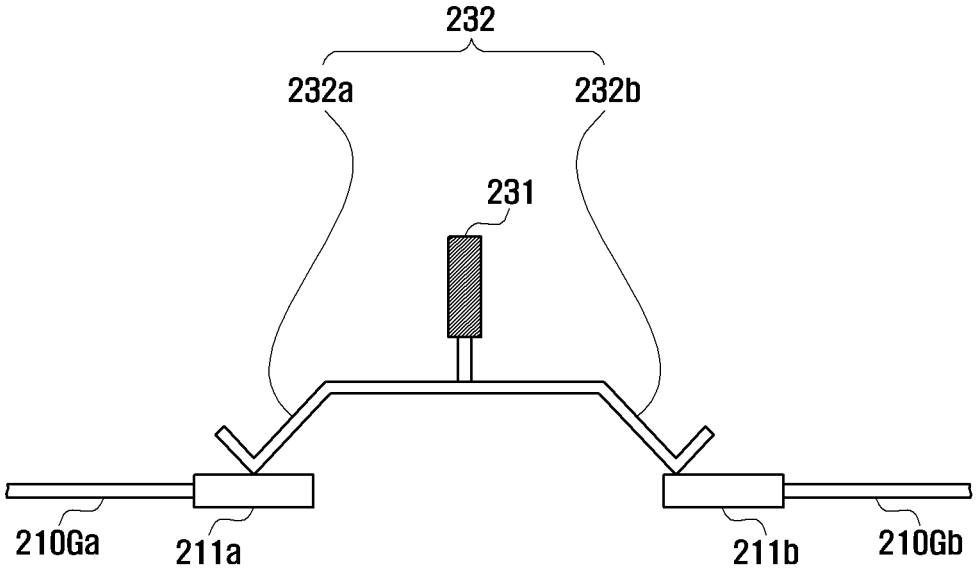
FIG. 3 illustrates an inside of a switch of an earphone antenna of a mobile terminal according to an exemplary embodiment of the present invention.
Figure 4:
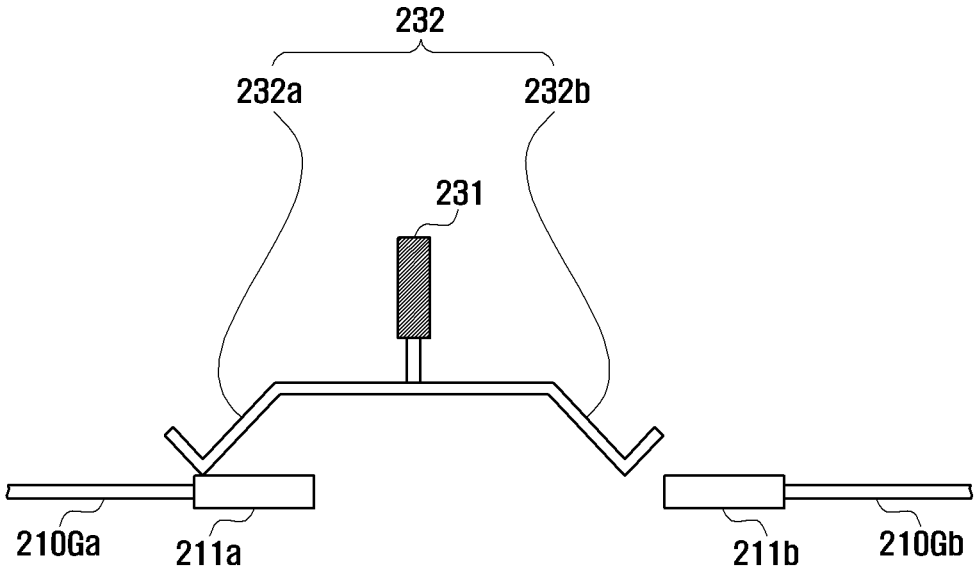
FIG. 4 illustrates an inside of a switch when a switch manipulator of an earphone antenna of a mobile terminal is positioned in a Digital Multimedia Broadcasting (DMB) antenna mode position (A) according to an exemplary embodiment of the present invention.
Figure 5:
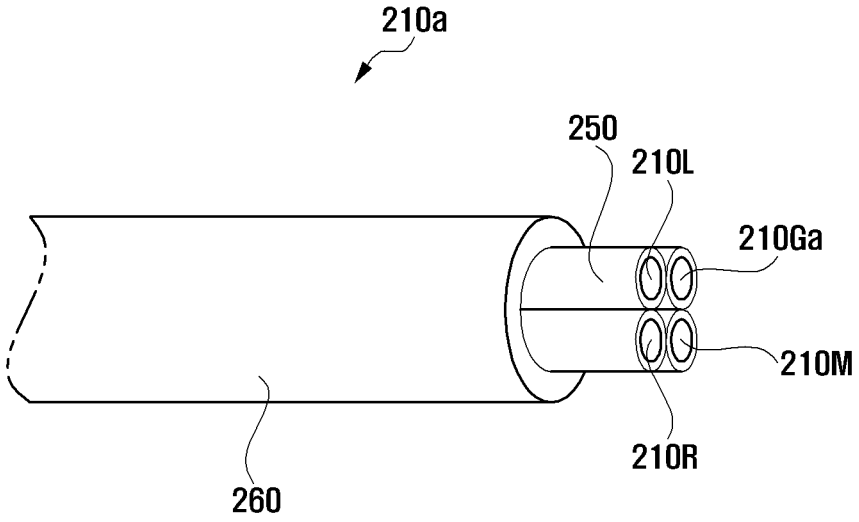
FIG. 5 illustrates an internal structure of a first connector cable of an earphone antenna of a mobile terminal according to an exemplary embodiment of the present invention.
Figure 6:
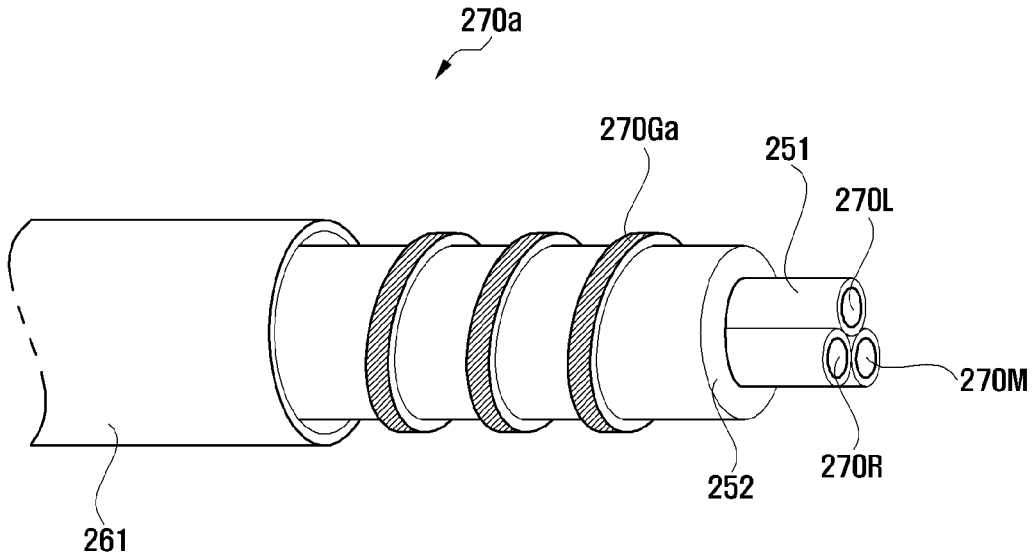
FIG. 6 illustrates an internal structure of a first connector cable according to an exemplary embodiment of the present invention.

FIG. 2 illustrates an earphone antenna of a mobile terminal according to an exemplary embodiment of the present invention. FIG. 3 illustrates an inside of a switch of an earphone antenna of a mobile terminal according to an exemplary embodiment of the present invention. FIG. 4 illustrates an inside of a switch when a switch manipulator of an earphone antenna of a mobile terminal is positioned in a Digital Multimedia Broadcasting (DMB) antenna mode position (A) according to an exemplary embodiment of the present invention. FIG. 5 illustrates an internal structure of a first connector cable of an earphone antenna of a mobile terminal according to an exemplary embodiment of the present invention. FIG. 6 illustrates an internal structure of a first connector cable according to an exemplary embodiment of the present invention.

Referring to FIGS. 2 through 6, an earphone antenna 200 of a mobile terminal may include a first connector cable 210*a*, a second connector cable 210*b*, and a switch 230.

The first connector cable 210*a* connects the earphone antenna 200 to a mobile terminal (not shown) and includes a first antenna line 210Ga for DMB. The first connector cable 210*a* includes an end formed with a connector 220 that is inserted into an earphone jack of a mobile terminal and the other end connected to the switch 230. The first connector cable 210*a*, as illustrated in FIG. 5, includes a left audio signal line 210L, a right audio signal line 210R, a microphone signal line 210M, and the first antenna line 210Ga, respectively coated with insulator 250. The insulation 250 is coated with an insulating jacket 260.

The left audio signal line 210L is connected to a left audio signal terminal 220L of the connector 200 and to a left earphone speaker 240L via the second connector cable 210*b* and a left speaker cable 241L. The right audio signal line 21 OR is connected to a right audio signal terminal 220R of the connector 220 and to a right earphone speaker 240R via the second connector cable 210*b* and a right speaker cable 241R. The microphone signal line 210M is connected to a microphone terminal 220M of the connector 220 and to a microphone (not shown). The first antenna line 210Ga is connected to a ground/antenna terminal 220G of the connector 220 and to a first antenna line terminal 211*a* of the switch 230.

DMB has a frequency band of about 174 MHz to 216 MHz, and a length thereof satisfying $\lambda/4$ is about 40 cm. Thus, as illustrated in FIG. 5, in a case where the first antenna line 210Ga is parallel to the first connector cable 210*a*, a length L1 of the first connector cable 210*a* may be 40 cm.

With reference to FIG. 6, the internal structure of the first connector cable will be described as follows. A first connector cable 270*a* of FIG. 6, like the first connector cable 210*a* of FIG. 5, includes a left audio signal line 270L, a right audio signal line 270R, and a microphone signal line 270M, respectively coated with an insulator 251 that is coated with an insulating jacket 261. However, the first connector cable 270*a* of FIG. 6 is different from the first connector cable 210*a* of FIG. 5, in which an insulation coating 252 is formed between the insulator 251 and the insulating jacket 261, and in which a first antenna line 270Ga spirally surrounds the insulating coating 252. Since the first antenna line 270Ga, as illustrated in FIG. 5, is not formed parallel to the first connector cable 210*a*, but forms a spiral shape, the first antenna line serving as a DMB antenna may be achieved with the short first connector cable.

The second connector cable 210*b* connects the switch 230 to the left and right speaker cables 241L and 241R, respectively, and includes a second antenna line 210Gb connected to the first antenna line 210Ga for receiving FM radio broadcasting. Since FM radio broadcasting has an FM band of about 88 MHz to 108 MHz shorter than that of a DMB band, but $\lambda/4$ is elongated, the second antenna line 210Gb is connected to the first antenna line 210Ga to form an antenna line longer than that of the first antenna line 210Ga for receiving FM radio broadcasting.

The second connector cable 210*b*, although the inside is not shown, similar to the first connector cable 210*a* in FIG. 5, includes a left audio signal line 210L, a right audio signal line 210R, a microphone line 210M, and a second antenna line 210Gb, respectively coated with insulator 250. If a microphone were formed on the path of the switch or the first connector cable 210*a*, the microphone line 210M would not be included in the second connector cable 210*b*. In this exemplary embodiment of the present invention, the second connector cable 210*b* is fixed to the switch 230.

The switch 230 electrically connects and separates the first antenna line 210Ga to and from the second antenna line 210Gb, and is provided between the first connector cable 210*a* and the second connector cable 210*b*. The switch 230 includes a manipulation unit 231, a manipulation terminal 232, a first antenna line terminal 211*a* connected to an end of the first antenna line 210Ga, and a second antenna line terminal 211*b* connected to an end of the second antenna line 210Gb. The manipulation unit 231 is manipulated for a user to select one of a DMB antenna mode and an FM radio broadcasting antenna mode. The manipulation terminal 232 is fixed to the manipulation unit 231 for electrically connecting and separating the first antenna line terminal 211*a* to and from the second antenna line terminal 211*b*, and includes a first manipulation terminal 232*a* to come in contact with the first antenna line terminal 211*a* and a second manipulation terminal 232*b* to come in contact with the second antenna line terminal 211*b*.

The switch operation will be described with reference to FIGS. 2 through 4. As illustrated in FIGS. 2 and 3, when the manipulation unit 231 is positioned at an FM radio broadcasting antenna mode position B, the first antenna line 210Ga is electrically connected to the second antenna line 210Gb. The first antenna line 210Ga and the second antenna line 210Gb serve as one FM radio broadcasting antenna in cooperation with each other. Thereafter, it is assumed that the manipulation unit 231 is positioned at the DMB antenna mode position B, as illustrated in FIG. 2. In this case, as illustrated in FIG. 4, the second manipulation terminal 232*b* is separated from the second antenna line 210Gb so that the first antenna line 210Ga is electrically separated from the second antenna line 210Gb. The first antenna line 210Ga serves as a DMB antenna alone.

Figure 7:
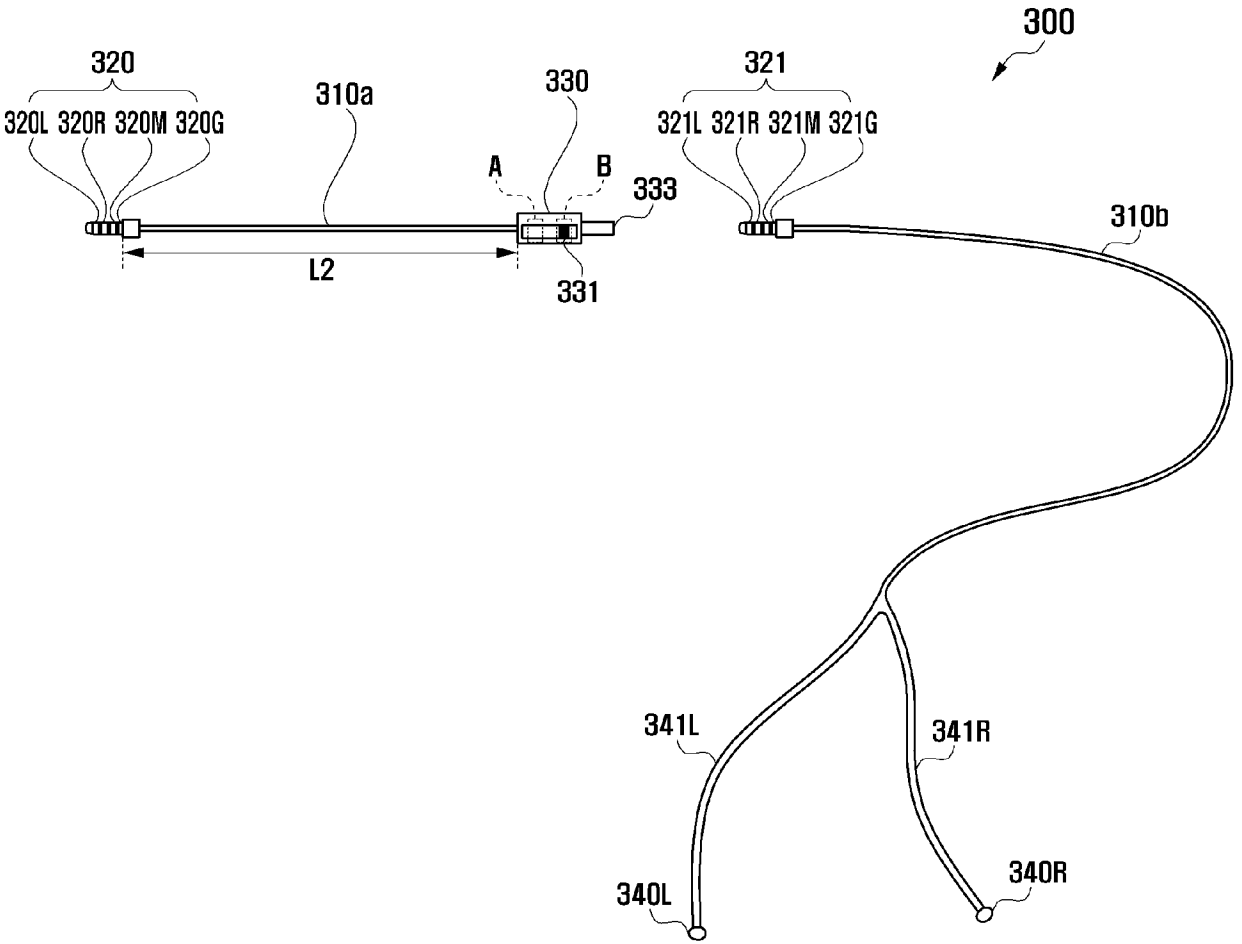
FIG. 7 illustrates an earphone antenna of a mobile terminal according to an exemplary embodiment of the present invention.

FIG. 7 illustrates an earphone antenna of a mobile terminal according to an exemplary embodiment of the present invention.

Referring to FIG. 7, an earphone antenna 300 of a mobile terminal may include a first connector cable 310*a*, a second connector cable 310*b*, and a switch 330.

In an exemplary embodiment of the present invention, unlike the earphone antenna 200, the second connector cable 310*b* is detachable from the switch 330. In order to form this structure, a connector 321 for connecting the second connector cable 310*b* to the switch 330 is formed at an end of the second connector cable 310*b* and the switch 330 includes an earphone jack 333 into which the connector 321 is inserted.

The connector 321 of the second connector cable 310*b*, similar to connector 320 of the first connector cable 310*a*, includes a left audio terminal 321L, a right audio terminal 321R, a microphone terminal 321M, and a ground/antenna terminal 321G. The left audio terminal 321L electrically connects the left audio signal line of the first connect cable 310*a* to the left audio signal line of the second connector cable 310*b*. The right audio terminal 321R electrically connects a right audio signal line of the first connector cable 310*a* to the right audio signal line of the second connector cable 310*b*. The microphone terminal 321M electrically connects the microphone signal line of the first connector cable 310*a* to the microphone signal line of the second connector cable 310*b*. The ground/antenna terminal 321G electrically connects the first antenna line of the first connector cable 310*a* to the second antenna line of the second connector cable 310*b*.

Similar to FIG. 2, a left audio signal line is connected to a left audio signal terminal 320L of the connector 320 and to a left earphone speaker 340L via the second connector cable 310*b* and a left speaker cable 341L. A right audio signal line is connected to a right audio signal terminal 320R of the connector 320 and to a right earphone speaker 340R via the second connector cable 310*b* and a right speaker cable 341R. A microphone signal line is connected to a microphone terminal 320M of the connector 320 and to a microphone (not shown). A first antenna line is connected to a ground/antenna terminal 320G of the connector 320 and to a first antenna line terminal of the switch 330. And similar to FIG. 5, in a case where the first antenna line is parallel to the first connector cable 310*a*, a length L2 of the first connector cable 310*a* may be 40 cm.

The earphone antenna 300 of a mobile terminal may be substantially identical to the earphone antenna 200 of a mobile terminal except for the directly above-mentioned structure.

According to an exemplary embodiment of the present invention, only the first connector cable 310*a* is connected to the earphone jack of the mobile terminal so that a user may watch a DMB program. In this case, sound of the DMB program is output through a speaker.

Moreover, when the connector 321 of the second connector cable 310*b* is connected to the earphone jack 333 of the switch 330, a user may watch a DMB program through earphone speakers 340L and 340R. A mobile terminal determines whether the second connector cable 310*b* is connected to the switch 330 by detecting resistance. When a manipulation unit 331 of the switch 330 is positioned at one of the DMB antenna mode position A and the FM radio broadcasting antenna mode position B, a user may watch a DMB program or listen FM radio broadcasting.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An earphone antenna of a mobile terminal, the earphone antenna comprising:

a first connector cable including a first antenna line for receiving Digital Multimedia Broadcasting (DMB);

a second connector cable including a second antenna line connected to the first antenna line for receiving Frequency Modulation (FM) radio broadcasting; and a switch positioned between the first connector cable and the second connector cable for electrically connecting and separating the first antenna line to and from the second antenna line.

2. The earphone antenna of claim 1, wherein a length of the first antenna line is 40 cm.

3. The earphone antenna of claim 1, wherein the switch includes a manipulation unit for allowing a user to select a DMB antenna mode and an FM radio broadcasting antenna mode.

4. The earphone antenna of claim 3, wherein the manipulation unit includes a manipulation terminal fixed thereto for electrically connecting and separating a first antenna line terminal connected to an end of the first antenna line and a second antenna line terminal connected to an end of the second antenna line.

5. The earphone antenna of claim 1, wherein the second connector cable is detachable from the switch.

6. The earphone antenna of claim 5, wherein the second connector cable includes a connector provided at an end thereof for connecting the second connector cable to the switch.

7. The earphone antenna of claim 6, wherein the switch includes an earphone jack into which the connector of the second connector cable may be inserted.

* * * * *